US010650641B2

(12) United States Patent
Badalyan

(10) Patent No.: US 10,650,641 B2
(45) Date of Patent: May 12, 2020

(54) HEDGING SYSTEM AND METHOD

(71) Applicant: Vivaro Ltd, Portomaso (MT)

(72) Inventor: Vigan Badalyan, San Gwann (MT)

(73) Assignee: VIVARO LTD, Portomaso (MT)

( * ) Notice: Subject to any disclaimer, the term of this patent is extended or adjusted under 35 U.S.C. 154(b) by 91 days.

(21) Appl. No.: 15/756,316

(22) PCT Filed: Aug. 31, 2016

(86) PCT No.: PCT/EP2016/070547

§ 371 (c)(1),
(2) Date: Feb. 28, 2018

(87) PCT Pub. No.: WO2017/037134

PCT Pub. Date: Mar. 9, 2017

(65) Prior Publication Data

US 2018/0247491 A1 Aug. 30, 2018

(30) Foreign Application Priority Data

Sep. 1, 2015 (GB) ..... 1515502.1
Sep. 4, 2015 (GB) ..... 1515719.1

(51) Int. Cl.
*G07F 17/32* (2006.01)

(52) U.S. Cl.
CPC ..... *G07F 17/3288* (2013.01); *G07F 17/323* (2013.01); *G07F 17/3223* (2013.01); *G07F 17/3234* (2013.01); *G07F 17/3258* (2013.01)

(58) Field of Classification Search
CPC ..... G07F 17/32
See application file for complete search history.

(56) References Cited

U.S. PATENT DOCUMENTS

2002/0147670 A1 10/2002 Lange
2013/0005444 A1 1/2013 Ginsberg et al.

OTHER PUBLICATIONS

Int'l Search Report and Written Opinion in co-pending PCT Application No. PCT/GB2016/070547, dated Feb. 10, 2017, 9 pgs.

*Primary Examiner* — Omkar A Deodhar
(74) *Attorney, Agent, or Firm* — Blank Rome, LLP

(57) ABSTRACT

A system and method for hedging the risk of a wager is disclosed. The system comprises a FCS with which multiple SCWSs are in communication, said FCS having access to a stored set of working parameters provided by each of said SCWSs, said parameters being indicative of the extent to which that computer wagering system is capable, currently or at a specific point in time, of financially covering wagers or portions thereof, characterised in that, on receiving an initial wager request at one of said secondary computer systems, said wager request is communicated to the first computer wagering system which calculates, using at least the sets of working parameters for at least two of the other SCWSs, whether and to what extent the initial wager could be apportioned between each of said at least two other computer wagering systems and communicates the result of such calculation to said first computer wagering system which can then either accept or decline the initial wager request.

15 Claims, 11 Drawing Sheets

HEDGING SYSTEM AND METHOD

FIELD OF THE INVENTION

The present invention relates to a hedging system and method, and more specifically to a hedging system and method utilising a computer or system of computers whereby the risk of accepting large bets can be hedged across multiple subscribers to the system.

BACKGROUND TO THE INVENTION

One of the primary aims of the majority of modern gaming companies is to secure more high quality revenue, such as by accepting bets from high net worth individuals who are well capable of financing their gambling habits, and are arguably less likely to default on their debts. Such individuals are herein referred to as VIP clients, and given the above, gaming companies are forever seeking to win more VIP business. The opportunity VIP business presents is clear, but all experienced operators know this business comes with its own issues and risks.

Wealthy individuals, naturally tend to be more risk seeking, and thus (although not always directly correlated) they tend to make larger bets as they can stand losing larger amounts of money. However, betting companies, particularly online gambling companies, bookmakers, gaming exchanges, spread-betting and CFD (contracts for difference) companies, etc., often impose maximum bet limits, margin limits and the like, and these limits are often well below the wager levels required or requested by VIP clients. Although advanced gaming exchanges and bookmaking companies may subject individuals to vetting procedures such as background financial checks, and/or require some collateral or margin funding from them before accepting any particularly large bet, but in most if not all cases, large bets still present a risk to the companies accepting them.

Although particularly risky bets are commonly declined regardless of the status of any individual, turning down a large bet placed by a VIP client can be seen as insulting to the VIP client, who may choose to take his business elsewhere.

By contrast, accepting a large bet from a VIP client, and then subsequently losing that bet, can have significant impacts on the cash-flows of the company who accepted the bet.

Applicant therefore has recognised the challenges of growing a gaming business; and have developed the present invention with the objects of assist their partners' attempts to secure VIP income and to manage the associated risks of accepting their bets

SUMMARY OF THE INVENTION

According to the present invention there is provided a system for hedging the risk of a wager comprising a first computer system (FCS) with which multiple secondary computer wagering systems (SCWS) are in communication, said FCS having access to a stored set of working parameters provided by each of said SCWSs, said parameters being indicative of the extent to which that computer wagering system is capable, currently or at a specific point in time, of financially covering wagers or portions initially received by one or more other SCWSs, characterised in that, on receiving an initial wager request at one of said secondary computer systems, said wager request is communicated to the first computer wagering system which calculates, using at least the sets of working parameters for at least two of the other SCWSs, whether and to what extent the initial wager could be apportioned between each of said at least two other computer wagering systems and communicates the result of such calculation to said first computer wagering system which can then either accept or decline the initial wager request.

Preferably, the parameters provided by each of the second computer wagering systems include one or more of: minimum/maximum stake limits, minimum/maximum payout limits, minimum/maximum odds limits, minimum/maximum collective risk limits, acceptable and unacceptable wager types, acceptable and unacceptable event types. For example, the parameters may specify particular acceptable or unacceptable sport or other event types, particular countries in which those sports or events are played, particular leagues or other subdivisions of the sport or event type, particular client types (howsoever such might can be quantified), and some indication of the relative size and standing of the company owning, and/or operating and/or providing the second computer wagering systems. In addition, a user may choose whether or not they only want to receive whole wagers, only want to share wagers, or whether they wish to do both receiving and sharing of wagers.

Preferably the parameters provided by each of the second computer wagering systems are stored in a manner which renders them accessible to said FCS, and further preferably said parameters are stored within said FCS, preferably on one or more storage media forming part of said FCS.

In a most preferred arrangement, the first computer wagering system utilises the parameters sets of both the one secondary computerised wagering system at which the initial wager request was received, and the other SCWSs with which the first computer wagering system is in communication and which are effectively advertising their availability for accepting a portion of the initial wager and shouldering a portion of the risk thereof, and also providing some indication of the extent of the exposure to that initial wager said other SCWSs would be prepared to accept.

Preferably, each of the SCWSs intermittently or periodically communicates a set of parameters to said FCS, said parameters being indicative of the extent to which the respective computer wagering system is capable, at that, or any other, specific point in time in the future, of financially covering wagers or portions thereof.

Preferably, the parameters include some indication of whether the respective SCWS

- is prepared to submit wagers initially received by it to the FCS for hedging by other SCWS, optionally specifically identifying and/or prioritising those SCWSs which are preferred over others, or to be specifically excluded by the hedging operation performed by said FCS,
- is prepared to accept hedge portions of wagers initially received by any one or more, howsoever specified, or all, SCWSs in communication with said FCS,
- can decline hedge portions of wagers initially received by any one or particular SCWSs, howsoever specified, in communication with said FCS,
- operates in a manner being any combination of the above.

Preferably, both FCS and one or more of the SCWSs can operate in one or both of: real money and free-play modes.

Preferably, in addition to, or as part of the set of parameters, the FCS stores some indication of a participation bonus, preferably in the form of a fraction or percentage, which each subscribing SCWS is set to receive after the outcome of any event on which one or more wagers hedged by said FCS are to be, are being, or have been settled. Preferably said bonus is calculated by said FCS based on one or more of: the initial amount wagered, a turnover or profit figure, or some derivative thereof. Most preferably, the participation bonus is settled between the operator of a particular secondary computer system and the operator of the FCS.

In a preferred embodiment, the operator of the SCWS may decide the participation bonus himself. In a most preferred arrangement, the participation bonus in included in the calculation of the FCS as to whether, and to what extent that particular SCWS can accept portions of wagers initially received by other SCWSs. In a most preferred embodiment, when included in the calculation, the participation bonus may additionally affect the odds of the portion of the wager attributed to a particular SCWS by the FCS.

Analogously to the participation bonus, the FCS may additionally store a payout or commission bonus, in the form of a fraction or percentage, such that each SCWS receives a payout or commission based on one or more of: a lost wager amount, a turnover figure, or some total number or amount of shared bets. The fraction or percentage may be set by the operator himself, and if used in the hedging calculation, may affect the odds of the portion of any wager which is attributed to a particular SCWS.

Preferably, the amount of any wager placed by an individual with a particular SCWS in communication with, and subscribing to the FCS is recorded in both the secondary and first computing systems so that from the individual's perspective, it seems that his wager is placed with, and accepted by, only one SCWS. In the alternative, where an individual places a large wager which is subsequently hedged by the FCS, the individual may see any one or more of:

- particular wager limits set by the operator of the SCWS, whether specific to that individual or generally applied, and/or any one or more of the parameters discussed above,
- whether the SCWS is connected to and/or is a subscriber of the FCS, and if so, other secondary computer systems in communication with and/or subscribers of said FCS.

In a particularly preferred embodiment, the FCS may also create, manage, and pay out a jackpot fund. In one embodiment, the set of parameters furnished by the SCWSs may additionally include some indication of whether, to what extent, that wagering system is prepared to contribute, preferably on a repeated or ongoing basis, to said jackpot fund. In one embodiment, financial contributions may be made to the jackpot fund by and/or from each of the SCWSs on the basis of a predetermined percentage of a turnover or profit figure, or of losing wagers.

It should be mentioned here that financial contributions, commissions, payouts and other monetary transactions and transferals between the FCS and SCWSs may be done using monetary accounts such as bank accounts, or using some form of deposit and/or credit accounting system which is associated with a particular system or to which said system has access, and this applies for both first and secondary computer systems. It is of course common for individuals registering with the computer wagering system of a particular operator to provide their bank account or credit card details so that the operator, up to certain prescribed and or predetermined limits, has free access to, and can withdraw money from or charge monetary amounts to, those accounts or credit cards. Of course, each secondary system may also be required, again as part of the set parameters furnished or separately, to provide account or other financial details in order that the FCS can make financial transfers to each of said secondary systems.

Preferably, the FCS is provided with a dedicated secure application programming interface (API).

Preferably, the FCS and the multiple SCWSs together form a 'swarm intelligence' network of interacting computer systems.

In one preferred embodiment, individuals seeking to place a wager with a particular operator of a SCWS may select from a plurality of different wager scenarios.

In a yet further preferred embodiment, the parameters furnished by the SCWSs may also include some indication of cumulative or ongoing financial turnover or profit/loss figure of the system as far as initial wagers received thereby and subsequently hedged, and portions of initial wagers received by other systems and partially apportioned thereto as part of the hedging process performed by the FCS. Preferably, a financial deposit may be required or made by each of the SCWSs—again the extent of such deposit (or alternatively, the amount to which that system is in credit to or debt with the FCS) may be described in the parameters furnished by the system. Alternatively the FCS may supplement each of the sets of parameters for each secondary system with such information. Again, this information, if utilised in the hedging calculation function, may affect on the amount of bets which a particular SCWS can share or receive from FCS.

Preferably, the parameters may also include some indication of the types of wagering channels offered by the operator of each of the SCWSs, and whether and to what extent the FCS is to be made accessible to the SCWSs, and thus individuals wagering through any one of those channels. Examples of wagering channels include web, betting shops/high street bookmakers, kiosks, terminal (whether fixed or varying odds), mobile, etc.

In one embodiment, the hedging calculation, and in particular limits determined thereby based on the parameters furnished by each of the secondary computer systems, may increase or decrease depending on the amount of financial deposits made by each of the SCWSs and number of currently active and/or subscribing participant (.i.e. secondary) systems.

In a secondary aspect, the invention provides a method of hedging the risk of and financial exposure to a wager comprising the steps of:

- Storing, in a FCS multiple sets of parameters being indicative of the extent to which each of multiple SCWSs are capable, currently or at a specific point in time, of financially covering wagers or portions thereof
- Receiving a wager request at a first SCWS
- Communicating said request to said FCS
- Performing a calculation, in said FCS and utilising at least two sets of parameters of SCWSs, one of which may be said first computer wagering system which received the wager request, whether and to what extent each of said SCWSs is prepared to shoulder the risk of the initial wager, and
- Communicating the result to said first computer wagering system.

Using the system proposed above, Applicant has provided a facility for wagering companies (often called 'partners') that facilitates increased revenues by accepting bets from players that may be greater than their established limits. With this system, such large bets may be split automatically between the first operator taking the bet and the networked 'cloud' of secondary operators. Hence the initial operator can receive a bet up to their limit and the remainder of the bet can be assumed by the cloud of secondary operators willing to assume a portion of the bet and thus shoulder some of the risk thereof.

Most desirably, the system includes a payment processing engine for distributing commissions of losing and winning bets, the risks of which were shouldered by one or more wagering entities other than that with which the bet was originally placed.

Most preferably, (for example), for all losing bets sent to the cloud of wagering operators, the sending operator will receive a commission of some sort, for example a guaranteed payment of their expenses on the bet, or perhaps some percentage based on the portion of the original wager they took on.

Applicant herefor also considers that the present invention may have wider application, and it is foreseeable that logic and the FCS which implements it may be extended to different products: for example, sportsbooks, virtual sports games, casino games, peer to peer games, skill games, fantasy sports, etc.

A specific embodiment of the invention is now described by way of example and with reference to the accompanying drawings wherein.

DETAILED DESCRIPTION

For the purposes of this specific description, and to aid explanation of the system of the present invention, it is useful to conceive at least two fictional gaming companies, arbitrarily called 'AlphaBet' and 'BetaBet', but of course it is envisaged that many more such companies will subscribe to, and will thus become partners of, the system. Alphabet and BetaBet are essentially bookmaking businesses capable of accepting bets on the outcome of events from individuals at predetermined odds, and paying out on those bets if the individual backed the correct event outcome.

Figure 1:
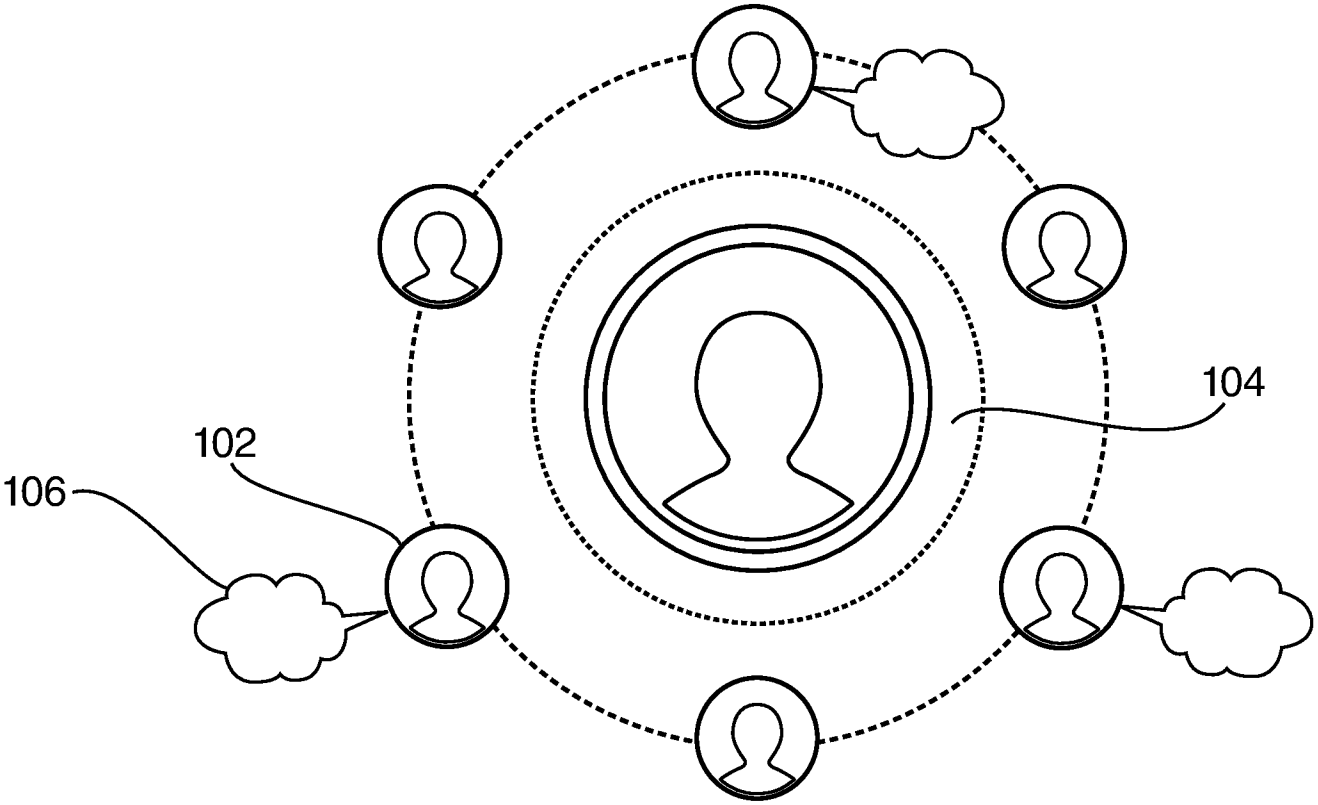
FIG. 1-9 schematically illustrate various different features of the invention.

In one scenario basically illustrated in FIG. 1, a VIP client 'John' 102 of company Alphabet 104, acting in isolation, seeks to place a very large bet. Under normal circumstances, Alphabet 104 would decline the bet as it is immediately recognised, either by machines or humans, as being above either a set limit for the company generally, or for the individual. In either case, but particularly the former case in the context hereof, the bet would commonly be refused and advice of this decision would be communicated to the individual 102 as indicated at 106.

For reasons mentioned above, gaming companies are desirous of accepting larger bets, particularly when they have great confidence in the wagering individual. The present invention provides a system where any one of the multiple companies at any time subscribing to the system can between them accept individual high value bets from individuals on the outcome of any event while simultaneously limiting their exposure should the bet require settlement after the outcome of the event is determined.

Figure 2:
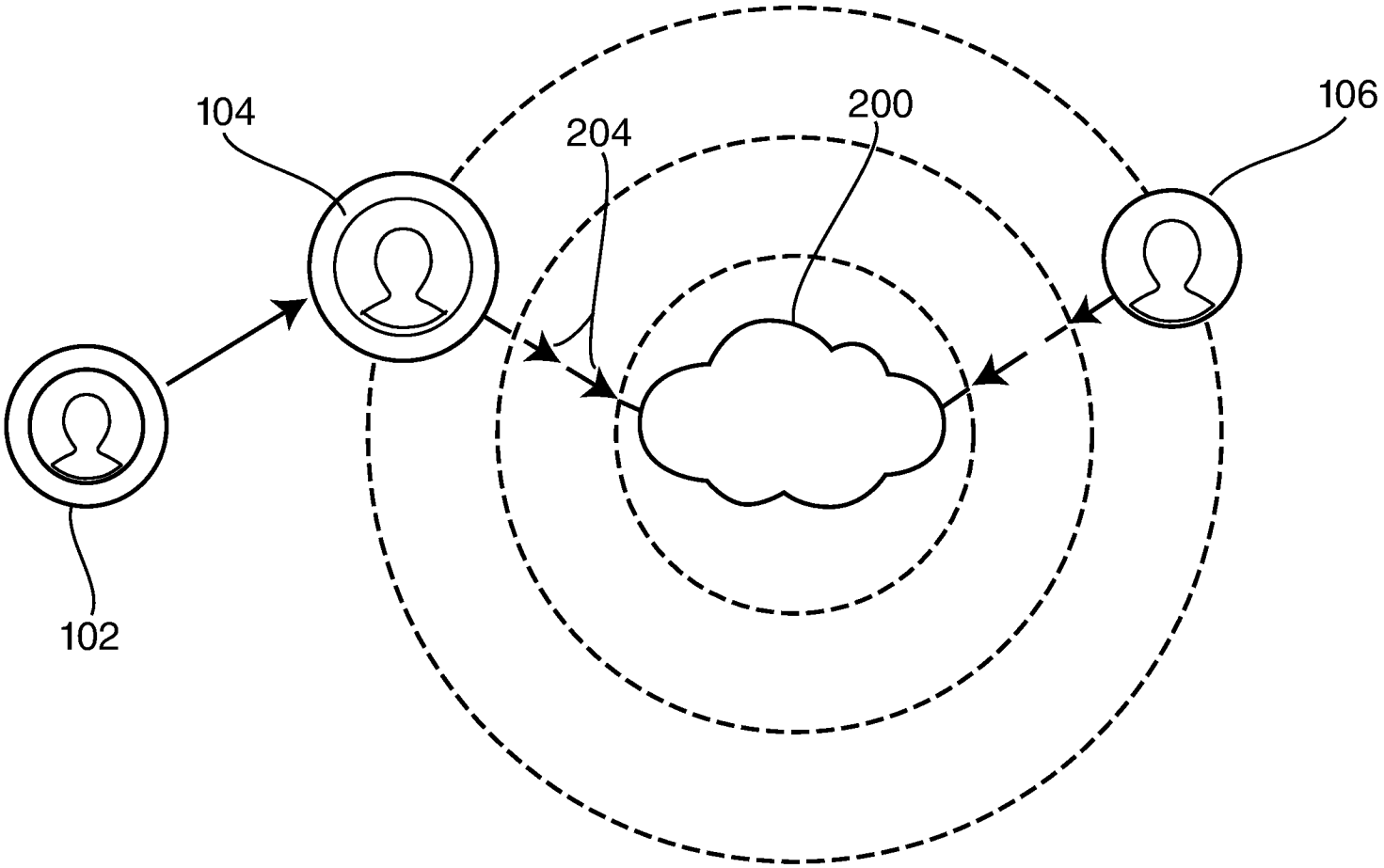

The system, basically illustrated in FIG. 2, referenced at 200 and labelled "BET CLOUD" is essentially a virtual betting platform to which company 104 Alphabet must first register with and subscribe to. The Figure also shows second company 206 ('BetaBet') as having registered with and subscribing to the system. Once these companies are approved as partners of the system operator, and any required subscription monies are paid (or as part of that process), Alphabet 104 and BetaBet 206 are required to furnish the system operator with some financial parameters, such as, e.g., a desired, required, or acceptable commission %, together with some indication of their bet limits, whether these be absolute or relative, and the types of events and/or bets they are prepared to accept, and those that they do not accept, to name but a few. These parameters are stored by the system for every subscribing partner company. The provision of such data is indicated generally at 202 for company 104, and at 208 for company 206. The parameters are checked by the FCS; for example, limits are settled between the FCS and the individual SCWS representative of a given user via a back-office reconciliation tool which forms a part of the system 200.

Figure 2A:
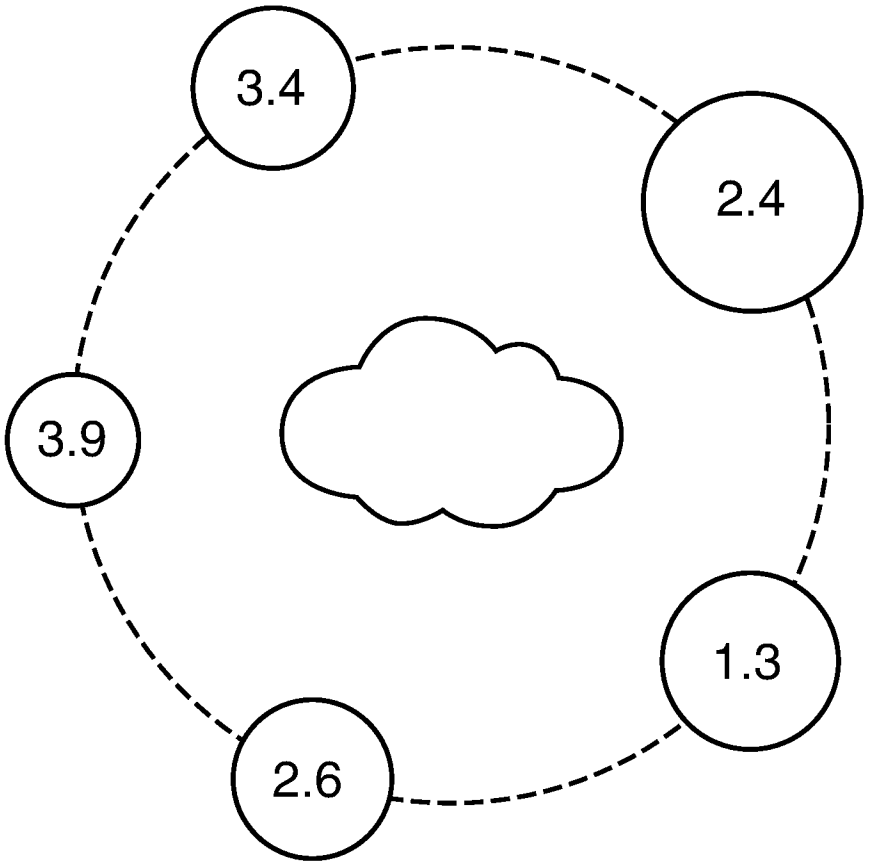

In the present scenario, VIP client John 102 now approaches his usual bookmaker Alphabet 104 and seeks to place a very large bet. Normally Alphabet would have to turn away the bet, but because AlphaBet is part of the larger BetCloud system 200, Alphabet's system can issue a request to the system 200 providing parameters of John's bet, for example including the amount sought to be wagered, the odds, the time to the particular event (or if multiple events, the last, and possibly the first, of them, if not all of them). In possession of this information, and also of the various parameters prescribed by each of the bookmaking companies subscribing to the system, said system can then determine whether, collectively, the subscribing partner bookmaking companies and Alphabet itself can accept the bet. As part of the system therefore, Alphabet's systems communicate with, and make a request of, the system 200, and system 200 communicates back a response—the system 200 thus provides a hedging function so that the single bet John placed with company 104 and which appears to John as a single bet having been made with that company is actually automatically hedged by the system among multiple bookmaking companies. Where multiple bookmaking companies subscribe to the system 200, a single large bet can ultimately be diluted amongst them all such that the individual risk to each company is very low. Alternatively, an algorithm may be employed by the system for determining which of the subscribing companies are selected or prioritised for hedging a large bet placed with a single (other) company also subscribing to the system. FIG. 2A illustrates how a different weighting factor may be calculated and assigned to each bookmaking company subscribing to the system. The algorithm will control the parameters such as maximum bet limits, maximum available odds and maximum payouts based on the limitations of each participant SWC, including its available funds, as well as country, product and sport based limitations.

When a portion of a bet is assigned, the liability about is checked by the FCS relative to the balance of the amount deposited in a given user account or accounts; the FCS sends a request to the bank or other place where the account is held and checks the balance of the account (or accounts) and on the basis of those findings, verifies the possibility of settling the shared bet among a given pool of participants, prior to calculating the manner in which the bet may be shared amongst to the said participants. Accepting and sharing the best is done in a single process in the FCS. The FCS and The SWCS(s) interact together in accordance with an internal protocol, via API calls, with the FCS comprising the calculations engine. A participant module comprises three key elements, namely, first a dashboard, showing representation of the shared big bets for the SCWS, secondly at least an information stream from the Betcloud bank, comprising financial accounts related to the SCWS, and a reporting service where the user can export reports, such as shared bets' reports, commission reports and financial reports. The betcloud module and a given participant module interact via API calls send from the given SWCS to the FCS and vice versa. Security is provided by ensuring that all or all appropriate communications occur via closed VPN tunnels.

Figure 3:
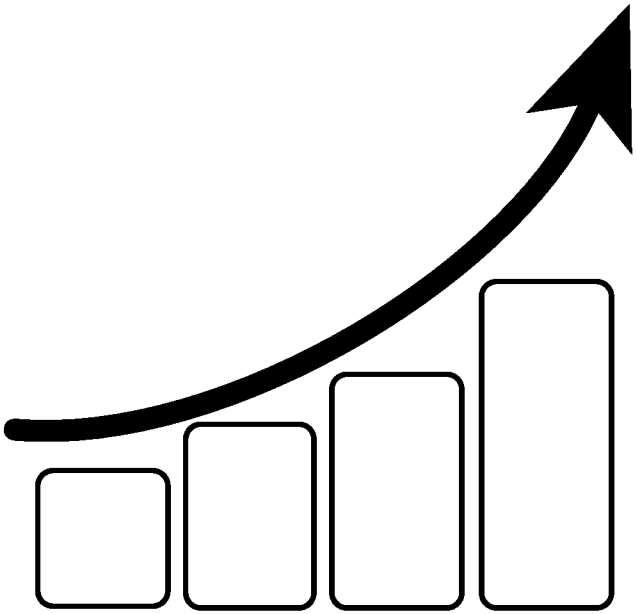

It is worth mentioning that the bet placed by John 102 is usually assessed by Alphabet, as between them and John alone, as being less than their single bet limit. However, such assessment need not automatically be applied—indeed the system does offer the possibility for bookmaking companies to substantially increase their single bet limit, at least for VIP clients. John 102, as the customer of Alphabet 104, is unaware of the transfer——all he knows or cares about is that the bet has been accepted. These ideas basically illustrated in FIG. 3.

Figure 4:
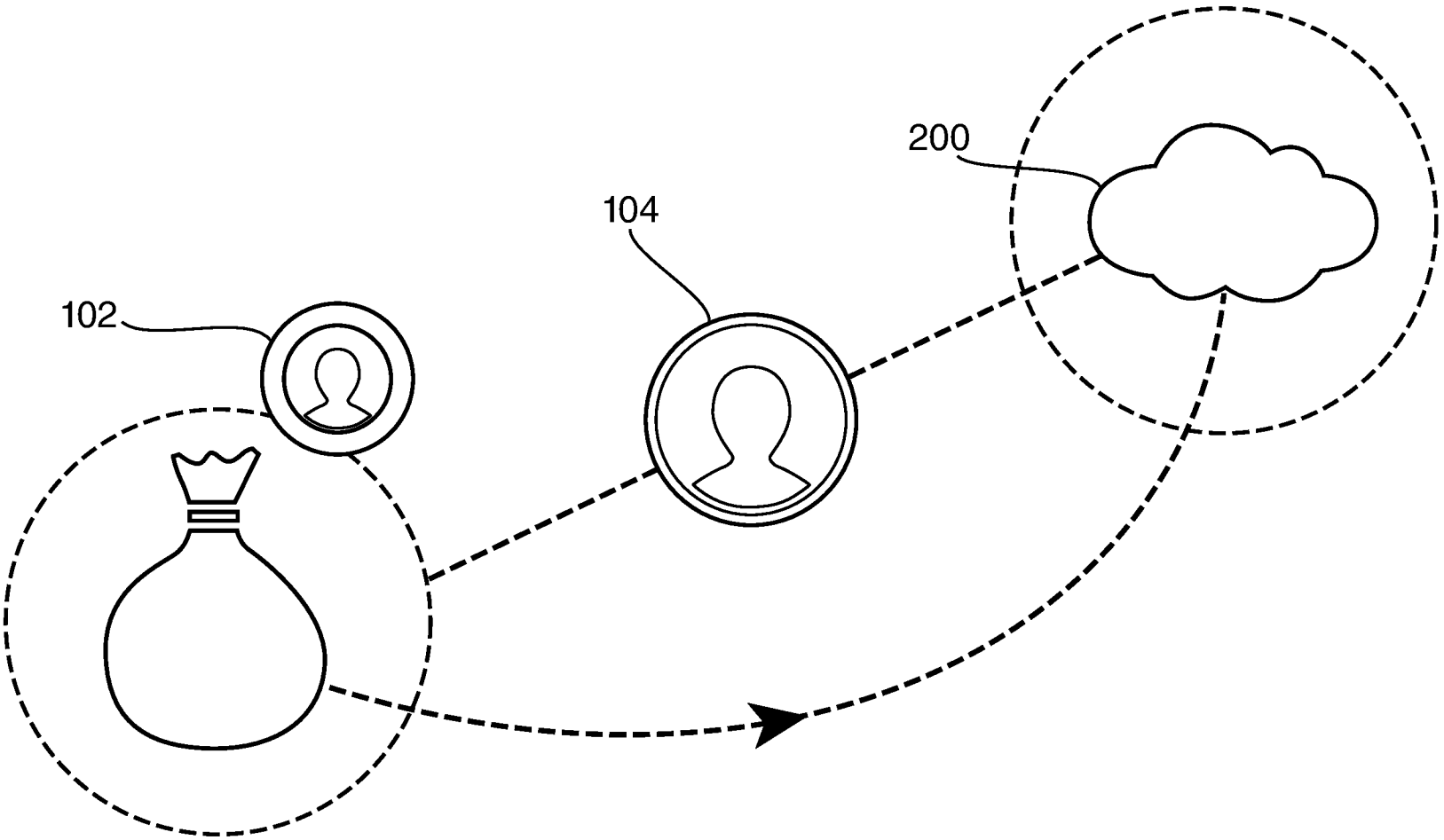
Figure 5:
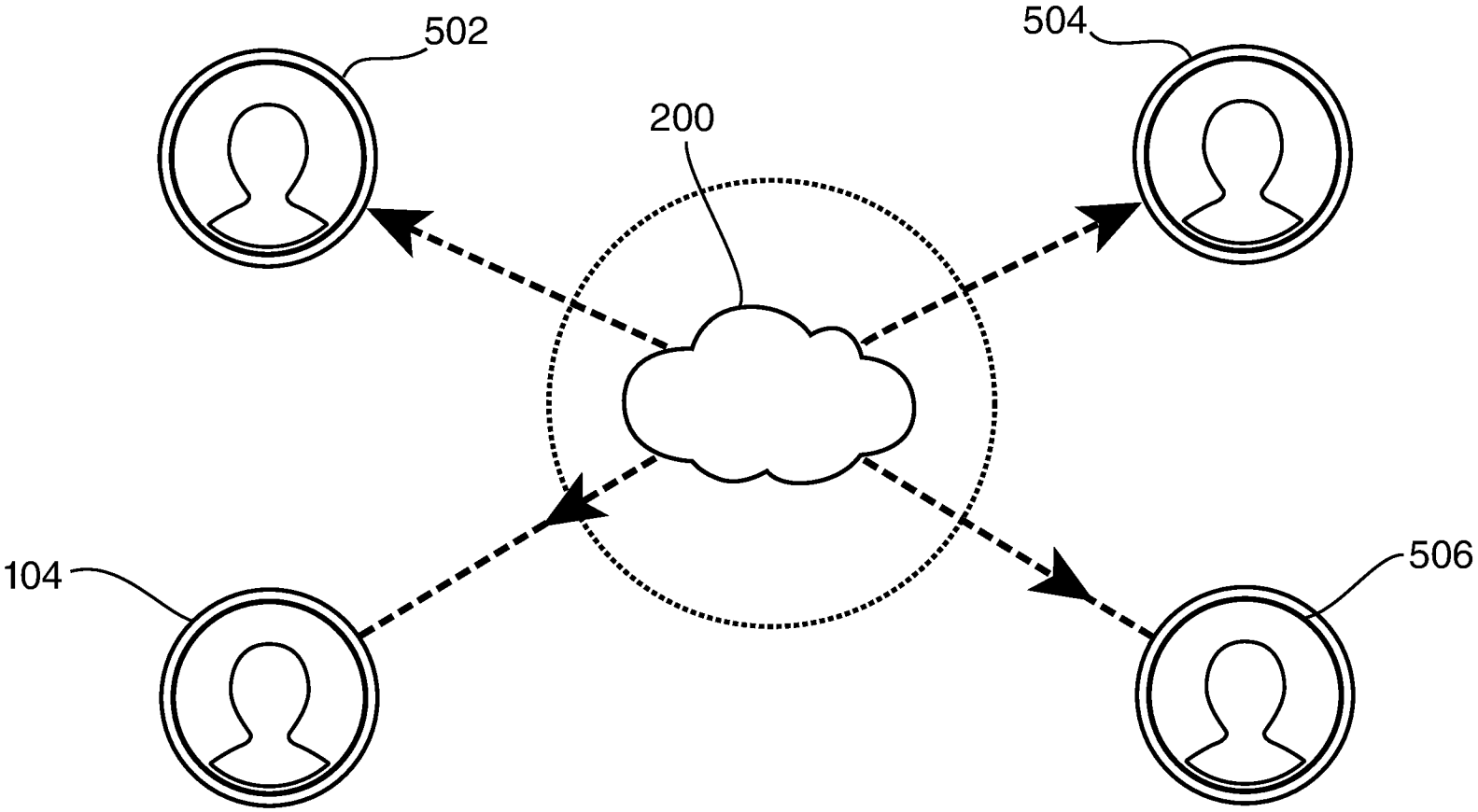

FIG. 4 basically illustrates the net effect of the system—although the large bet of John 102 is initially made directly with Alphabet company 104, ultimately it is the system 200 which provides the hedging function, and therefore (in most cases), it is the various other companies which subscribe to the system that will be carrying the majority of the risk of the initial single large bet. This is represented in FIG. 5, wherein various other companies 502, 504, 506, as well as company 104 are represented as being subscribers of the system 200.

Figure 6:
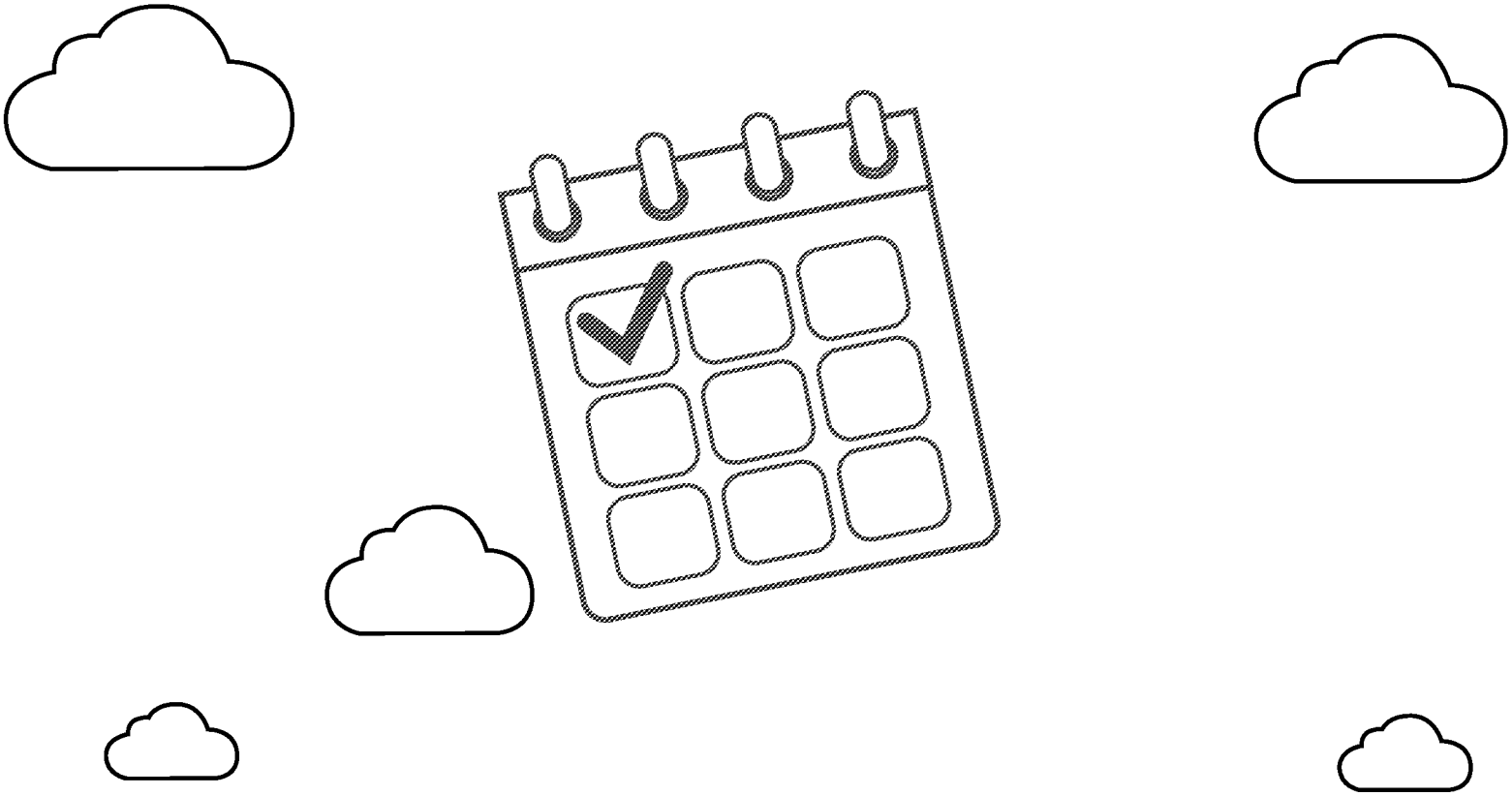

After the bet has been accepted, and then placed with the various bookmaking companies, the event takes place and its outcome determines whether the bet is a successful one or not. (FIG. 6) The accepting of the bet and the sharing of the bet are done through the same set of transactions between the FCS and the one or more SCWS via an internal protocol, such as a TCP level protocol. In some embodiments, conventional data types will be used, in others extended data types or a mix of extended and conventional data types will be used.

Figure 7:
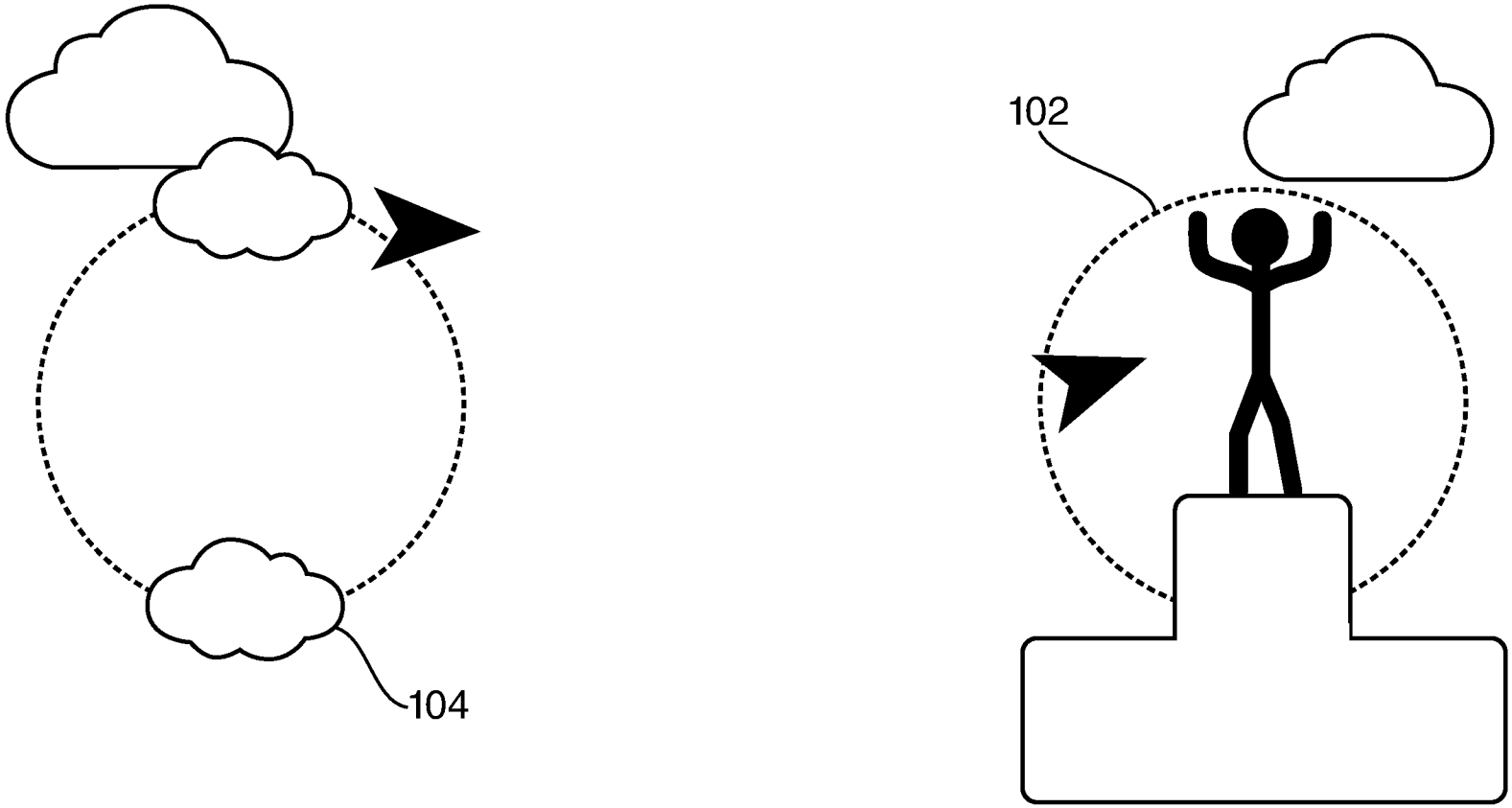
Figure 8:
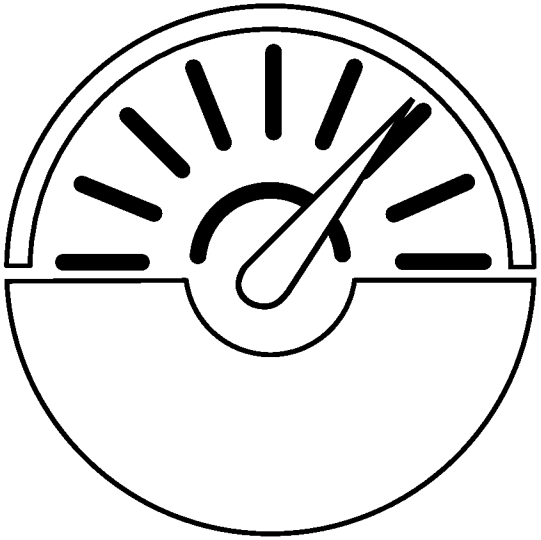
Figure 9:
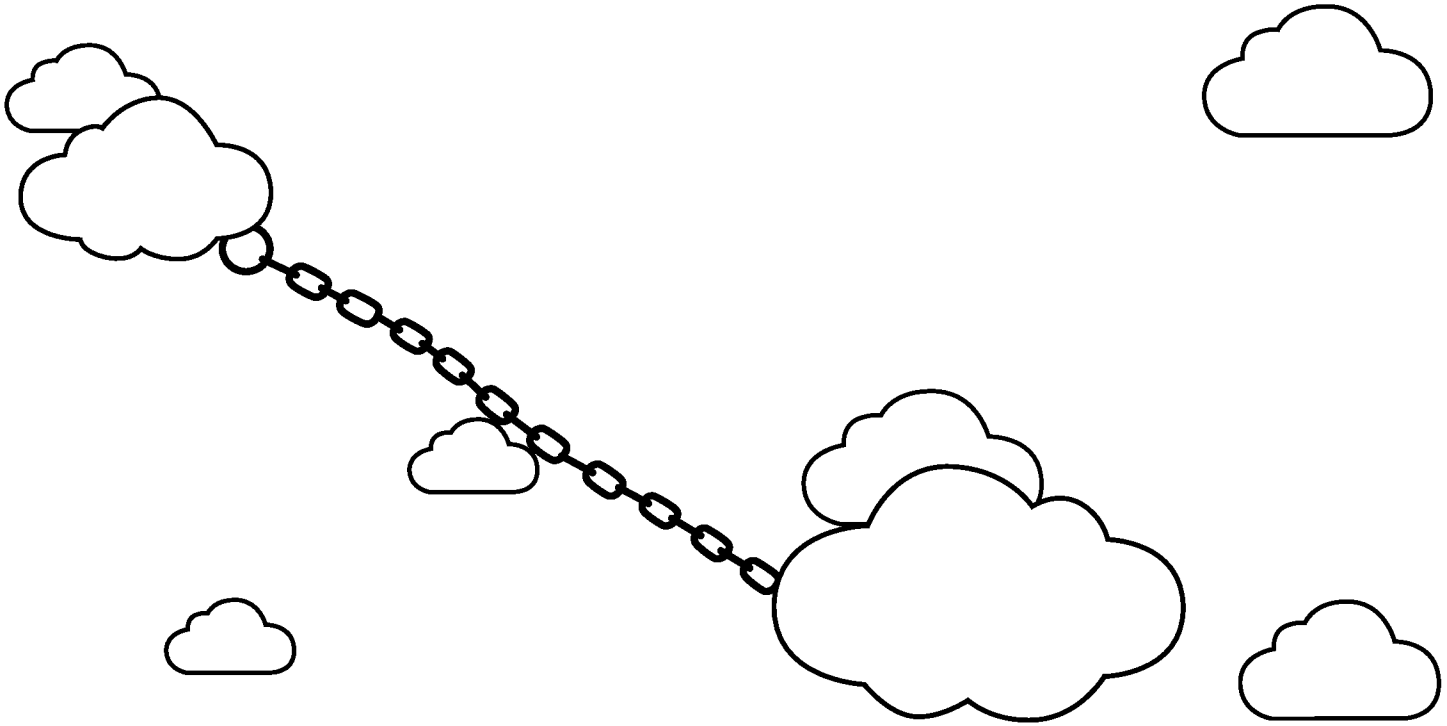

If the bet is a winning bet (See FIG. 7) for John 102, Alphabet company 104 will process the result and settle their portion of the bet as usual. However, to maintain the illusion that John 102 has placed a single bet with company 102, and that company accepted the bet entirely on its own, the system may automatically collect, or make requests for payment from, each of the various other companies who accepted some portion of the initial bet. Once all these separate portions are collected, they can be delivered by the system 200 to a relevant account of company 104 so that John receives only a single payment of winnings from the company 104 he initially placed with bet with. Accordingly, by hedging the risk among many different bookmakers, the cashflow of company 104 is not significantly affected, or at least not as affected as it would have been had they had to entirely pay on John's winning bet. Despite John winning his bet, A further somewhat abstract advantage of the capability of company 104 being able to accept John's large bet is that after a winning bet, John's account with that company swells significantly, and there is an innate propensity for gamblers to wager more when they are 'in credit'—thus there is an increased likelihood that John makes one or more future wagers. With each future wager, John's likelihood of winning decreases, and thus the chances of company 104 recouping their loss increases.

If the bet is a losing bet, company Alphabet 104 profits from the wager in various ways, some directly financial, others being of a more abstract nature but nevertheless beneficial. In the latter category, for example, company 104 accepted the bet from John, and therefore John will be far less likely change bookmakers—contrastingly, he would be much more likely to do this if his bet had been refused. In terms of the former category, as the initial bet is diluted and hedged between multiple subscriber companies, the system pays a commission to each company, again algorithmically or simply determined based on a direct percentage of the risk each company shouldered. Company Alphabet 104 also receive their appropriate share of this commission from the system. In one embodiment, the actual sum wagered is passed immediately from company 104 to the system 200, and it from the reserves/account(s) of the system that such commissions are paid.

A further advantage of the system is for the other subscribing bookmaker companies to receive at least some payment for bets they initially did not sell. Thus in a system where multiple bookmaking companies subscribe to the system, all offering different types of bets on different events, it should be possible for any large bet to be hedged within the system.

The system may also provide a commission payment platform by means of which the various subscribing companies receive commissions from other subscribing companies for whom they provided a hedging service. One example of an accounting mechanism by which financial payments are made between the first and secondary computer systems is described below. In this regard, the term "bank" is intended to encompass any form of financial account or repository which provides some indication of a monetary amount present therein (or absent therefrom).

The main meaning of the bank is to organize and make cash transfers between the FCS and each of the subscribing SCWSs as part of the wager hedging function, and as part of the financial settlement function performed by the FCS after the outcome of an event on which wagers have been placed.

As a specific example: a SCWS 'A' receives an initial wager of 10.000 from an individual; A subscribes to FCS, and has furnished a profit margin parameter, being a coefficient of 1.5; the initial wager of 10,000 is shared with FCWS 'B' at the coefficient (meaning 5,000 is the profit margin). Regardless of result (the punter wins or loses) the bank of A is deducted with the bet principal amount −10,000 (in case of loss to secure the money for B), and the bank of B is deducted with the profit margin (in case of win to secure profit margin for A). If the individual wins the bet, A must pay to him 15,000, so the deducted 10,000 is reimbursed to A, also A's bank rises with profit margin 5,000 from B, which already had been deducted from B's bank.

Alternatively, if the client loses the bet, which means that B makes a profit of 10,000. So the A ought to give the bet's principal amount 10,000 to B, so the previously deducted 10,000 from A's bank, adds to B's bank. In addition to this, B must pay to A from his profit 4% commission (10.000*4%=400), which means 400 is deducted from B's bank and is transferred to A's bank. In the tables below, the cash part of the bank shows the cash deposits and withdrawals of the particular SCWS, also any corrections specific to it.

In Case of Won Bet

| SCWS 'A' INCOME STATEMENT | | | SCWS 'B' INCOME STATEMENT | | |
|---|---|---|---|---|---|
| ACCEPTED | Received bets | | ACCEPTED | Received bets | 10,000 |
| | Won accepted bets | | | Won accepted bets | (15,000) |
| | Lost bets | | | Lost bets | — |
| | Commission out | — | | Commission out | — |
| SHARED | Shared bets | 10,000 | SHARED | Shared bets | |
| | Lost shared bets | — | | Lost shared bets | |
| | Commission in | — | | Commission in | — |
| | Profit | — | | Profit | (5,000) |

In Case of Lost Bet

| PARTNER A INCOME STATEMENT | | | PARTNER B INCOME STATEMENT | | |
|---|---|---|---|---|---|
| ACCEPTED | Received bets | | ACCEPTED | Received bets | 10,000 |
| | Won accepted bets | | | Won accepted bets | |
| | Lost bets | | | Lost bets | 10,000 |
| | Commission out | — | | Commission out | (400) |
| SHARED | Shared bets | 10,000 | SHARED | Shared bets | |
| | Lost shared bets | 10,000 | | Lost shared bets | |
| | Commission in | 400 | | Commission in | — |
| | Profit | 400 | | Profit | 9,600 |
| Opening balance | | — | Opening balance | | — |
| CASH | Deposit | 100,000 | CASH | Deposit | 100,000 |
| | Withdrawal | | | Withdrawal | |
| | Correction | | | Correction | |
| ACCEPTED | Probable profit margin | | ACCEPTED | Probable profit margin | (5,000) |
| | Profit margin restore | | | Profit margin restore | 5,000 |
| | Lost bets principle | | | Lost bets principle | 10,000 |
| | Commision out | — | | Commision out to sharer | (400) |
| SHARED | Bet amount | (10,000) | SHARED | Bet amount | |
| | Bet amount restore | | | Bet amount restore | |
| | Won profit margin | | | Won profit margin | |
| | Commission in | 400 | | Commission in | |
| Closing balance | | 90,400 | Closing balance | | 109,600 |

Figure 10:
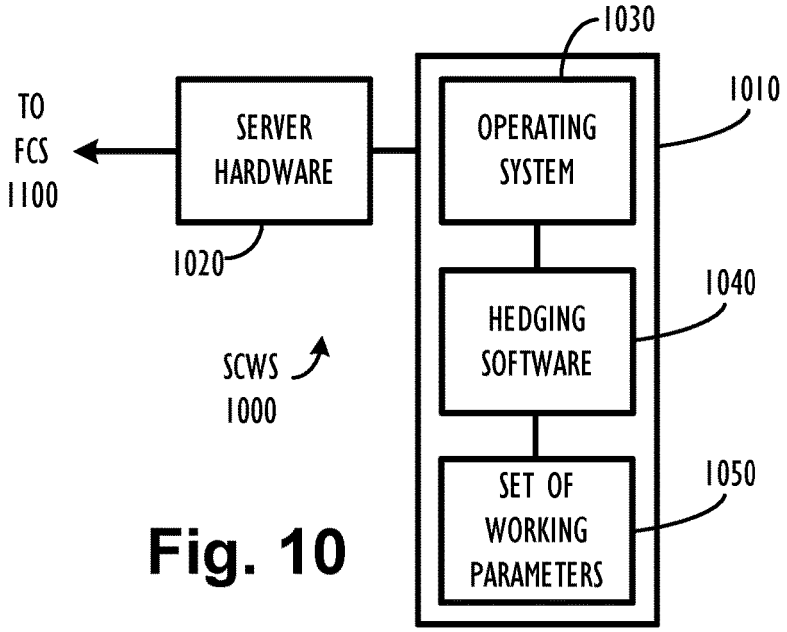
FIG. 10 is a block diagram of a computer according to the present invention.

FIG. 10 provides an illustration of an exemplary SCWS 1000. Server hardware 1020 provides the hardware component, while memory 1010 stores an operating system 1030, hedging software 1040 to allow the SCWS 1000 to operate as described and a set of working parameters 1050. The memory 1010 includes both working RAM and non-volatile storage, such as hard drives and the like. The server hardware 1020 is connected to an FCS 1100.

Figure 11:
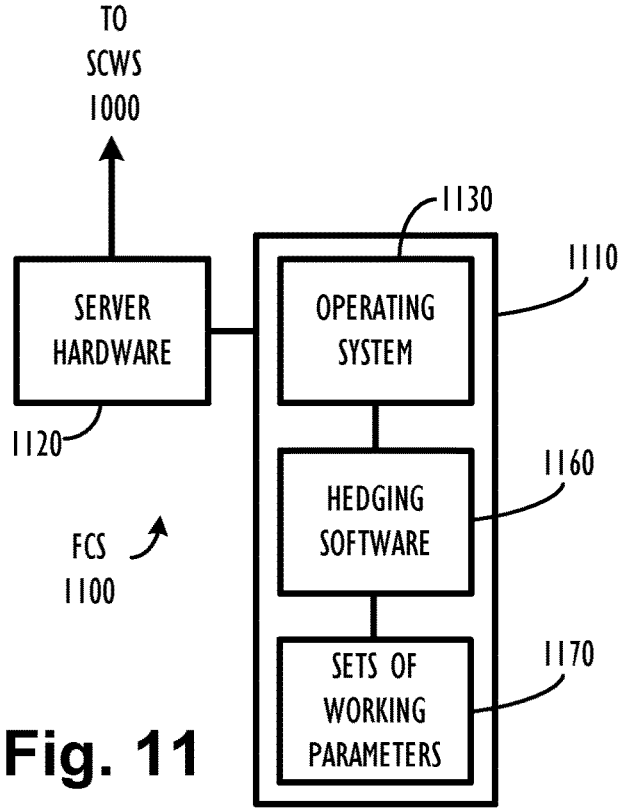
FIG. 11 is a block diagram of a computer according to the present invention.

FIG. 11 provides an illustration of an exemplary FCS 1100. Server hardware 120 provides the hardware component, while memory 1110 stores an operating system 1130, hedging software 1160 to allow the FCS 1100 to operate as described and sets of working parameters 1150 from each SCWS 1000. The memory 1110 includes both working RAM and non-volatile storage, such as hard drives and the like. The server hardware 1120 is connected to each SCWS 1000.

The system further comprises a back office tool which is provided as part of each SWCS and also each FCS. For the SWCS is shows all details regarding bets done, bets rejected on the cloud and financial information, along with infographics and other forms of visual presentation.

The invention claimed is:

1. A non-transitory program storage device or devices comprising instructions to cause one or more processors at a plurality of local computer wagering systems and a central computer to perform a method for automated bet sharing without awareness by the bettor, the method comprising the steps of:

storing bet parameters at each local computer wagering system, the bet parameters including local limit parameters and bet sharing parameters;

providing the bet sharing parameters from each local computer wagering system to the central computer;

receiving bet sharing parameters at the central computer from each local computer wagering system;

receiving at a first local computer wagering system a bet from a bettor;

providing a request for sharing at least a portion of the bet from the first local computer wagering system to the central computer after receiving a bet from a bettor in excess of the local limit parameters;

receiving a request for sharing at least a portion of the bet from the first local wagering system at the central computer;

determining approval of sharing the at least a portion of the bet by the central computer utilizing received bet sharing parameters from each local computer wagering system;

providing a message indicating approval of the sharing the at least a portion of the bet from the central computer to the first local computer wagering system;

receiving at the first local computer wagering system a message indicating approval of sharing the at least a portion of the bet; and providing approval of the bet to the bettor by the first local computer wagering system after receiving the message indicating approval of sharing the at least a portion of the bet, the above occurring without the awareness of the bettor of the sharing of the bet.

2. The non-transitory program storage device or devices of claim 1, wherein the steps of providing the bet sharing parameters from each local computer wagering system to the central computer and receiving bet sharing parameters at the central computer from each local computer wagering system are performed repeatedly.

3. The non-transitory program storage device or devices of claim 1, wherein the step of determining approval of sharing the at least a portion of the bet by the central computer utilizing received bet sharing parameters from each local computer wagering system includes determining which of the other local wagering computer systems is assigned a share of the at least a portion of the bet, and wherein the method further comprises the steps of:

providing assigned share information from the central computer to each other local computer wagering system assigned a share of the bet; and receiving at each of the local computer wagering system assigned a share of the bet the assigned share information.

4. The non-transitory program storage device or devices of claim 1, the method further comprising the steps of:

providing the bet outcome from the first local computer wagering system to the central computer; and receiving the bet outcome at the central computer from the first local wagering system.

5. The non-transitory program storage device or devices of claim 4, wherein the step of determining approval of sharing the at least a portion of the bet by the central computer utilizing received bet sharing parameters from each local computer wagering system to determine includes determining which of the other local wagering computer systems is assigned a share of the at least a portion of the bet and wherein when the bet outcome is a win by the bettor, the method further comprises the steps of:

providing payment requests from the central computer to the other local computer wagering systems for the assigned share of the at least a portion of the bet;

receiving payment from the other local computer wagering systems at the central computer in response to the payment requests;

providing payment of the at least a portion of the bet to the first local computer wagering system from the central computer after receiving payment from each of the other local computer wagering systems; and receiving at the first local computer wagering system the payment of the at least a portion of the bet from the central computer.

6. A non-transitory program storage device or devices comprising instructions to cause one or more processors at a first of a plurality of local computer wagering systems in communication with a central computer to perform a method for automated bet sharing without awareness by the bettor, the method comprising the steps of:

storing bet parameters at the first local computer wagering system, the bet parameters including local limit parameters and bet sharing parameters;

providing the bet sharing parameters from the first local computer wagering system to the central computer;

receiving at the first local computer wagering system a bet from a bettor;

providing a request for sharing at least a portion of the bet from the first local computer wagering system to the central computer after receiving a bet from a bettor in excess of the local limit parameters;

receiving at the first local computer wagering system a message indicating approval of sharing the at least a portion of the bet after determining approval of sharing the at least a portion of the bet by the central computer utilizing received bet sharing parameters from each local computer wagering system to determine; and providing approval of the bet to the bettor by the first local computer wagering system after receiving the message indicating approval of sharing the at least a portion of the bet, the above occurring without the awareness of the bettor of the sharing of the bet.

7. The non-transitory program storage device or devices of claim 6, wherein the step of providing the bet sharing parameters from the first local computer wagering system to the central computer is performed repeatedly.

8. The non-transitory program storage device or devices of claim 6, wherein the central computer receives a request to share at least a portion of a bet from another local computer wagering system and the central computer determines approval of sharing the at least a portion of the bet, including determining which of the other local wagering computer systems is assigned a share of the at least a portion of the bet, the first local computer wagering system being one of the other local computer wagering systems assigned a share, and wherein the method further comprises the step of:

receiving at the first local computer wagering system assigned a share of the bet the assigned share information.

9. The non-transitory program storage device or devices of claim 6, the method further comprising the step of:

providing the bet outcome from the first local computer wagering system to the central computer.

10. The non-transitory program storage device or devices of claim 9, wherein when the bet outcome is a win by the bettor, the method further comprises the step of:

receiving at the first local computer wagering system the payment of the at least a portion of the bet from the central computer.

11. A non-transitory program storage device or devices comprising instructions to cause one or more processors of a central computer in communication with a plurality of local computer wagering systems to perform a method for automated bet sharing without awareness by the bettor, the method comprising the steps of:

receiving bet sharing parameters from each local computer wagering system, the bet parameters including local limit parameters and bet sharing parameters;

receiving a request for sharing at least a portion of a bet in excess of the local limit parameters from a first local wagering system;

determining approval of sharing the at least a portion of the bet by the central computer utilizing received bet sharing parameters from each local computer wagering system; and providing a message indicating approval of the sharing the at least a portion of the bet to the first local computer wagering system, the above occurring without the awareness of the bettor of the sharing of the bet.

12. The non-transitory program storage device or devices of claim 11, wherein the step of receiving bet sharing parameters at the central computer from each local computer wagering system is performed repeatedly.

13. The non-transitory program storage device or devices of claim 11, wherein the step of determining approval of sharing the at least a portion of the bet by the central computer utilizing received bet sharing parameters from each local computer wagering system includes determining which of the other local wagering computer systems is assigned a share of the at least a portion of the bet, and wherein the method further comprises the step of:

providing assigned share information from the central computer to each other local computer wagering system assigned a share of the bet.

14. The non-transitory program storage device or devices of claim 11, the method further comprising the step of:

receiving the bet outcome at the central computer from the first local wagering system.

15. The non-transitory program storage device or devices of claim 14, wherein the step of determining approval of sharing the at least a portion of the bet by the central computer utilizing received bet sharing parameters from each local computer wagering system to determine includes determining which of the other local wagering computer systems is assigned a share of the at least a portion of the bet and wherein when the bet outcome is a win by the bettor, the method further comprises the steps of:

providing payment requests from the central computer to the other local computer wagering systems for the assigned share of the at least a portion of the bet;

receiving payment from the other local computer wagering systems at the central computer in response to the payment requests; and providing payment of the at least a portion of the bet to the first local computer wagering system from the central computer after receiving payment from each of the other local computer wagering systems.

* * * * *